US011223890B2

(12) United States Patent
Schoeck et al.

(10) Patent No.: US 11,223,890 B2
(45) Date of Patent: Jan. 11, 2022

(54) PERSONAL AUDIO DEVICE WITH IMPROVED OUTER EAR FIT

(71) Applicant: Microsoft Technology Licensing, LLC, Redmond, WA (US)

(72) Inventors: Kaitlyn Marley Schoeck, Seattle, WA (US); Timothy Guyton Escolin, Seattle, WA (US); John Richard Morris, Bothell, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/375,826

(22) Filed: Apr. 4, 2019

(65) Prior Publication Data

US 2020/0322709 A1 Oct. 8, 2020

(51) Int. Cl.
*H04R 1/10* (2006.01)

(52) U.S. Cl.
CPC ..... *H04R 1/1016* (2013.01); *H04R 1/105* (2013.01); *H04R 1/1041* (2013.01); *H04R 2420/07* (2013.01)

(58) Field of Classification Search
None
See application file for complete search history.

(56) References Cited

U.S. PATENT DOCUMENTS

2006/0067556 A1* 3/2006 Bailey ..... H04R 1/105 381/380
2008/0187159 A1* 8/2008 Blanchard ..... A61F 11/08 381/328
2009/0285436 A1* 11/2009 Lowry ..... H04R 1/1016 381/380
2011/0261988 A1* 10/2011 Kromann ..... H04R 1/1016 381/380
2012/0237068 A1* 9/2012 Fretz ..... H04R 25/656 381/330
2014/0286515 A1 9/2014 Bone et al.
2014/0376765 A1* 12/2014 Toelle ..... H04R 1/1058 381/384

(Continued)

FOREIGN PATENT DOCUMENTS

EP 2905972 A2 8/2015
WO 2010127265 A2 11/2010

OTHER PUBLICATIONS

"Backbeat Fit 3100." Poly, 2018, www.poly.com/us/en/products/headsets/backbeat/backbeat-fit-3100. (Year: 2018).*

(Continued)

*Primary Examiner* — James K Mooney
(74) *Attorney, Agent, or Firm* — Ray Quinney & Nebeker P.C.; Paul N. Taylor

(57) ABSTRACT

An electronic device for playing audio information to a user includes a body and an ear insert. The body has a speaker therein. The ear insert includes an integrated fin and sound director. The fin and sound director are oriented opposite one another at opposite ends of the ear insert in a longitudinal direction. The fin and sound director each project beyond the body in the longitudinal direction. The sound director is in audio communication with the speaker to direct sound from the speaker through and out of the sound director.

19 Claims, 10 Drawing Sheets

(56) References Cited

U.S. PATENT DOCUMENTS

| | | | | |
|---|---|---|---|---|
| 2015/0110320 | A1* | 4/2015 | Liu | H04R 1/1016 381/322 |
| 2015/0156579 | A1* | 6/2015 | Lowry | H04R 1/1016 381/380 |
| 2017/0094384 | A1 | 3/2017 | Trainer et al. | |
| 2018/0035192 | A1* | 2/2018 | Houle | H04R 1/1016 |
| 2019/0116415 | A1* | 4/2019 | Qian | H04R 1/406 |
| 2019/0200112 | A1* | 6/2019 | Briggs | H04R 1/1016 |
| 2020/0084546 | A1* | 3/2020 | Mainini | H04R 5/0335 |

OTHER PUBLICATIONS

"Review: Plantronics BackBeat Fit 3100." phonescoop, Nov. 28, 2018, www.phonescoop.com/articles/article.php?a=21452#gg=10684&gp=83626. (Year: 2018).*

Katz, Lily. "Plantronics BackBeat FIT 3100 review." soundguys, Jun. 12, 2020, www.soundguys.com/plantronics-backbeat-fit-3100-review-21034/. (Year: 2020).*

"Plantronics BackBeat FIT 3100 Review | True Wireless Sport Earbuds." YouTube, uploaded by Bits Tribe, Sep. 25, 2019. https://www.youtube.com/watch?v=LVvIW73WLMk. (Year: 2019).*

"BackBeat FIT User Guide." Plantronics, 2017. (Year: 2017).*

Kritsonis, Ted. "Plantronics BackBeat Fit 3100 review." techradar, Mar. 1, 2019, www.techradar.com/uk/reviews/plantronics-backbeat-fit-3100. (Year: 2019).*

"Reki Backbeat Fit 3100 Ear Tips | Silicone Earbuds Eartips Ear Gels Compatible with Plantronics BackBeat FIT 3100 2100 Wireless Sports Headphones—4pcs (Black)." Amazon, Nov. 7, 2018, amazon.com/Reki-Backbeat-Compatible-Plantronics-Headphones/dp/B07K8VFZF7?th=1. (Year: 2018).*

O'Kane, Sean. "Bose Soundsport Free Review: Truly Wireless Earbuds Never Sounded so Good." The Verge, www.theverge.com/circuitbreaker/2017/10/27/16508068/bose-soundsport-free-review-truly-wireless-earbuds. (Year: 2017).*

Additional images from Zeman "Review: Plantronics BackBeat Fit 3100" (Year: 2018).*

"International Search Report and Written Opinion Issued in PCT Application No. PCT/US20/024799", dated Jun. 12, 2020, 14 Pages.

* cited by examiner

PERSONAL AUDIO DEVICE WITH IMPROVED OUTER EAR FIT

CROSS-REFERENCE TO RELATED APPLICATIONS

N/A

BACKGROUND OF THE DISCLOSURE

Portable electronic devices are commonly used in public spaces and carried with a person throughout a day. The ability to engage with the audio of a personal electronic device privately for the entire day is important for privacy in communications as well as convenience of entertainment without disturbing other people around the user. A person can use a personal audio device to play audio from the personal electronic device to the user directly and privately. Conventional personal audio devices are secured to the user by inserting the personal audio device into the ear canal, such as an earbud, or by positioning the personal audio device over the head and/or over or on the outer ear, such as earphones.

The use of an earphone or earbud to listen to the audio of the personal device can impair the user's ability to hear conversations, audible notifications from other devices, traffic while walking or driving, or other sounds. The impairment of the user's hearing is inconvenient, at best, and dangerous, at worst. This impairment, therefore, presents a barrier to the adoption of audio information from a user's personal electronic device as a reliable form of notification throughout the day. Devices that allow the user to hear environmental sounds are less stable than occluding devices, limiting the functionality of the devices.

SUMMARY

In some embodiments, an electronic device for playing audio information to a user's ear includes a body and an ear insert. The body has a speaker therein. The ear insert includes an integrated fin and sound director. The fin and sound director are oriented opposite one another with the fin at a first end and the sound director at a second end opposite the first end in the longitudinal direction. The fin and sound director each project beyond the body in the longitudinal direction. The first end is configured to contact the anti-tragus/anti-helix concha of the user's ear and the second end is configured to contact a tragus of the user's ear when in an inserted position in the user's ear. The second end does not occlude the ear canal when in the inserted position.

In some embodiments, an electronic device for playing audio information to a user includes a body and an ear insert. The body has a speaker therein. The ear insert includes an integrated fin and sound director. The fin and sound director are oriented opposite one another at opposite ends of the ear insert in a longitudinal direction. The fin and sound director each project beyond the body in the longitudinal direction. The sound director is in audio communication with the speaker to direct sound from the speaker through and out of the sound director.

In some embodiments, a kit for a personal audio device includes a body, a first ear insert, and a second ear insert. The first ear insert and second ear insert are each selectively connectable to the body at a post. The body has a speaker therein. The first ear insert includes an integrated fin and sound director. The fin and sound director are oriented opposite one another at opposite ends of the ear insert in a longitudinal direction. The fin and sound director each project beyond the body in the longitudinal direction. The sound director is in audio communication with the speaker to direct sound from the speaker through and out of the sound director. The first ear insert has a first length and a first height. The second ear insert includes an integrated fin and sound director. The fin and sound director are oriented opposite one another at opposite ends of the ear insert in a longitudinal direction. The fin and sound director each project beyond the body in the longitudinal direction. The sound director is in audio communication with the speaker to direct sound from the speaker through and out of the sound director. The second ear insert has a second length and a second height. The second ear insert differs from the first ear insert in at least one of length or height.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 1-2 is a top view of the personal audio device of FIG. 1-1, according to at least one embodiment of the current disclosure;

FIG. 2 is a perspective front view of another personal audio device, according to at least one embodiment of the current disclosure;

FIG. 5-1 is a side view of an outer ear;

FIG. 5-2 is a side view of a personal audio device being positioned in the outer ear of FIG. 5-1, according to at least one embodiment of the current disclosure;

FIG. 5-3 is a side view of the personal audio device of FIG. 5-2 being secured in an outer ear, according to at least one embodiment of the current disclosure;

DETAILED DESCRIPTION

This disclosure generally relates to devices, systems, and methods for providing audio communications in a portable device. More specifically, the present disclosure relates to personal audio devices that allow improved environmental awareness. The personal audio device may rest in a user's outer ear and direct audio information into the user's ear canal without occluding the ear canal. The user can hear audio information from the personal audio device without impairing environmental sounds around the user. The user can, therefore, use the personal audio device throughout the day and continue to have conversations with other people, hear environmental sounds to more easily recognize potential hazards such as traffic, and use other devices without needing to remove and replace the personal audio device during the day.

Figure 1:
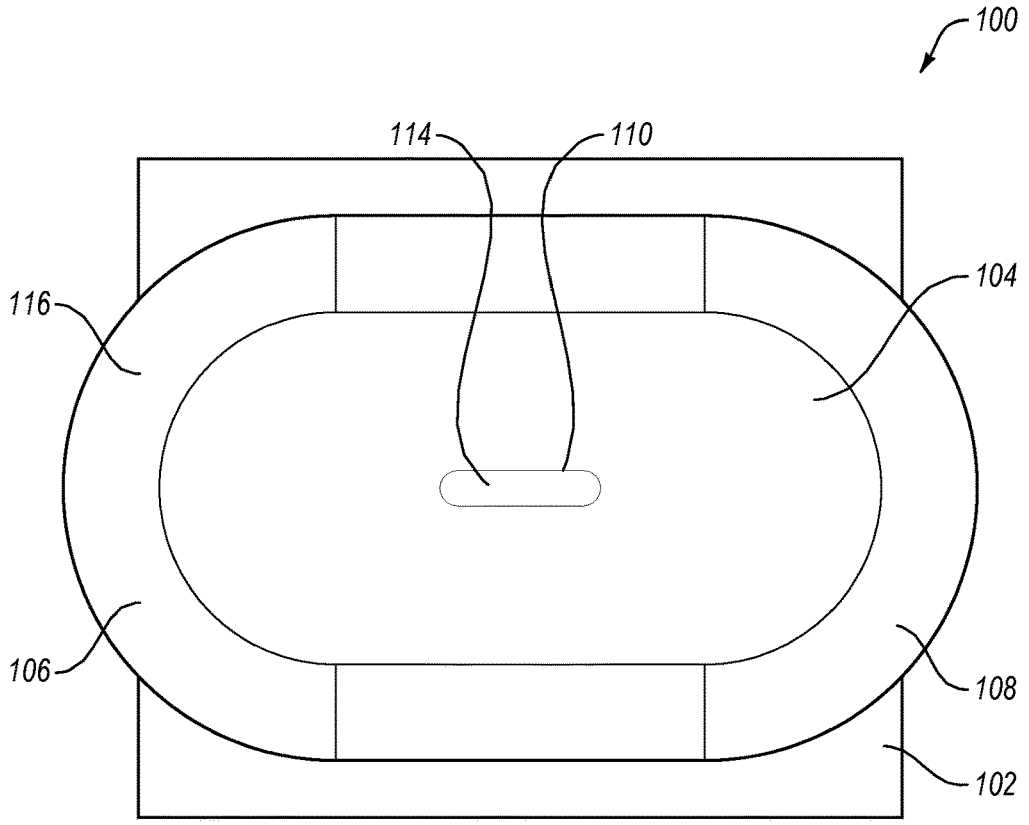
FIG. 1-1 is a rear view of a personal audio device, according to at least one embodiment of the current disclosure.

FIG. 1-1 is a rear view of a personal audio device 100 according to the present disclosure. The personal audio device 100 has a body 102 and an ear insert 104. The body 102 can contain a plurality of electronic components that can receive and/or transmit data to another electronic device. The electronic components of the body 102 allow the personal audio device 100 to generate audio information based on the data through a speaker and transmit the audio information through the ear insert 104 to a user's ear.

The electronic components may include a power supply, speaker driver, a processor, memory in data communication with the processor, a communication device in data communication with the processor (such as a wired or wireless communication device) that receives and/or transmits the data, or other electronic components. In some embodiments, the personal audio device 100 is a wireless personal audio device 100 that communicates with a personal electronic device or other electronic device via a wireless communication protocol, such as BLUETOOTH. In other embodiments, the personal audio device 100 is a wired personal audio device 100 that is in electrical communication with a personal electronic device or other electronic device.

The body 102 is connected to an ear insert 104 that has a first end 106 and a second end 108 positioned at an opposite end of the ear insert 104. The ear insert 104 has an opening 110 through which sound may be directed from a speaker 114 of the body 102.

The ear insert 104 further includes a fin 116 that projects from the body 102 in an opposite direction from the second end 108. The fin 116 applies a force to the user's ear to hold the ear insert 104 in compression between at least two points of the user's outer ear and to help align the opening 110 at the user's ear canal, as will be described in greater detail.

Figures 1, 2:
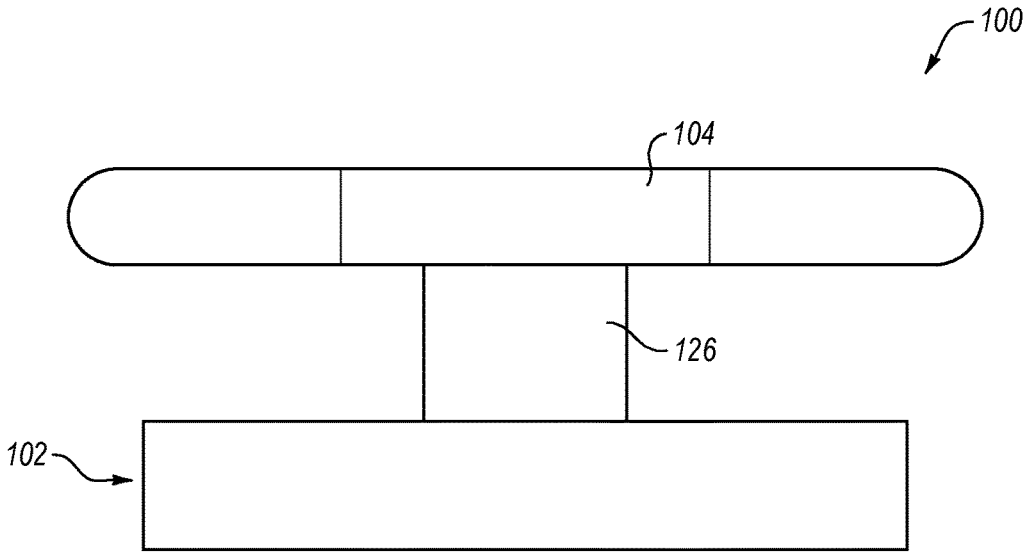
Figure 2:
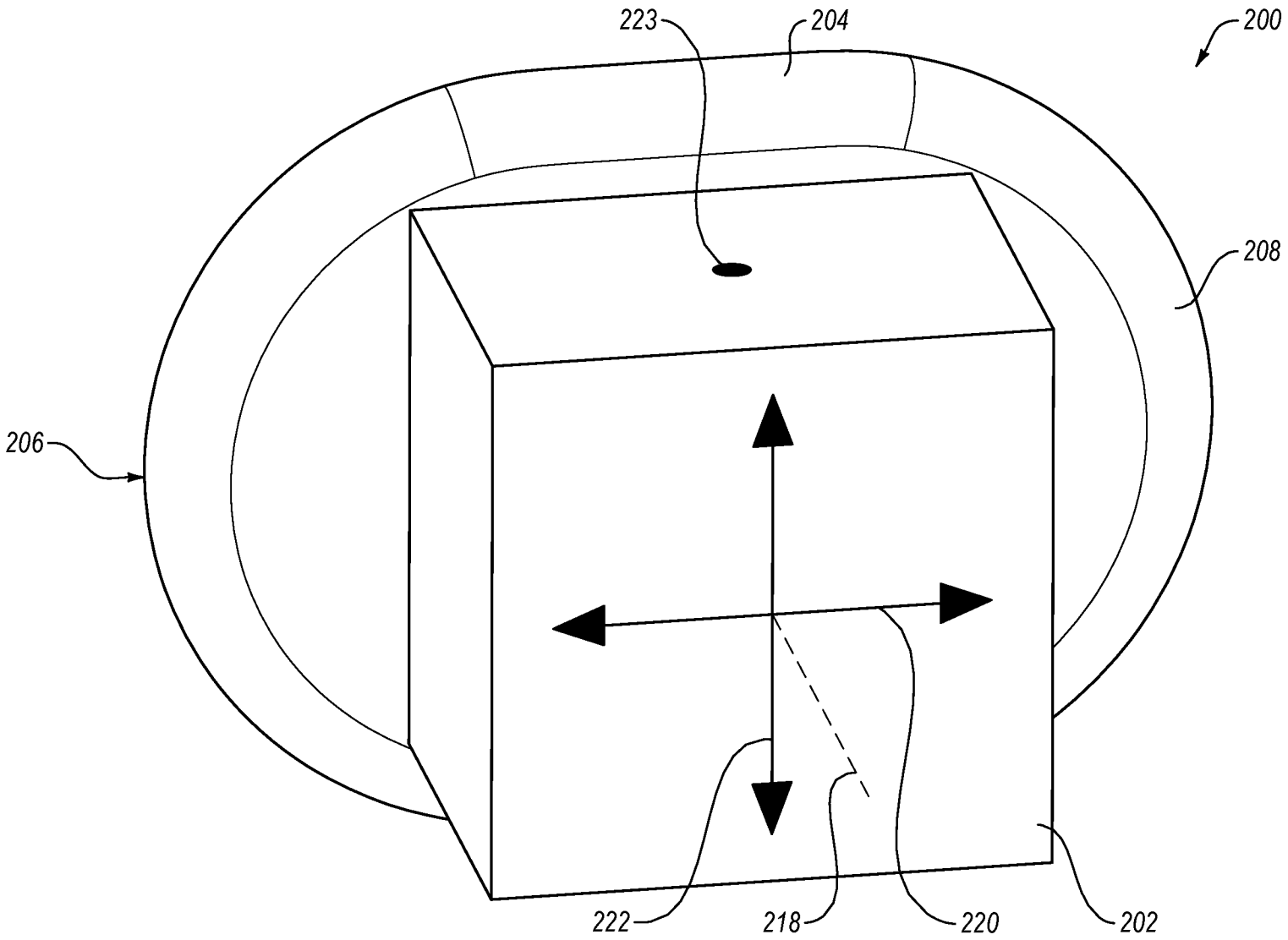

FIG. 1-2 is a top view of the personal audio device 100 of FIG. 1-2. The body 102 includes a post 126. The post 126 supports the ear insert 104 and allows the ear insert 104 to support the body 102 when positioned in a user's outer ear. In some embodiments, the post 126 is a tapered portion of the body 102. In other embodiments, the post 126 is a discrete portion of the personal audio device 100 that is selectively connectable to the body 102. For example, the post 126 may be adjustable and/or interchangeable to customize a distance from the ear insert 104 to an outer surface of the body 102.

In some embodiments, the ear insert 104 projects beyond the post 126 such that the ear insert 104 can hook behind a feature of the outer ear and the body 102 can remain outside the outer ear. For example, the ear insert 104 may project beyond the post in a longitudinal direction, a vertical direction, or both. In other embodiments, at least a portion of the ear insert 104 projects beyond a portion of the body 102. For example, the ear insert 104 may project beyond the body in a longitudinal direction, a vertical direction, or both.

FIG. 2 is a top perspective view of another embodiment of a personal audio device 200, according to the present disclosure. The personal audio device 200 has a body 202 that is connected to an ear insert 204 that is longer and taller than the body 202. The ear insert 204 is configured to be positioned in the structure of the user's outer ear, and the body 202 may project outward from the user's outer ear in the direction of a body axis 218. The ear insert 204 contacting the user's ear may retain the personal audio device 200 in position relative to the user's outer ear with sufficient force to allow the user to interact with one or more controls on the body 202 without the personal audio device 200 dislodging from the user's outer ear.

In some embodiments, the ear insert 204 has a first end 206 that projects beyond the body 202 of the personal audio device 200 in a longitudinal direction 220. The ear insert 204 can also have a second end 208 that projects beyond the body 202 in the opposite longitudinal direction 220. The ear insert 204, thereby, can tuck behind the structure of the user's outer ear without the body 202 contacting the outer ear and potentially causing discomfort.

The ear insert 204 can project beyond the body 202 in the vertical direction 222, similarly to in the longitudinal direction. In some embodiments, the ear insert 204 projects above the body 202 in the vertical direction 222. In other embodiments, the ear insert 204 projects below the body 202 in the vertical direction 222. In yet other embodiments, the ear insert 204 projects both above and below the body 202 in the vertical direction 222. In at least one embodiment, at least a portion of the ear insert 204 projects beyond the body 202 in both longitudinal directions 220 and both vertical directions 222.

In some embodiments, the body 202 includes a microphone 223. The microphone 223 may be a beam-forming microphone to receive and/or collect audio information in a particular direction. In some embodiments, the microphone 223 is configured to collect environmental sounds for noise cancelling purposes. In other embodiments, the microphone 223 is configured to collect the user's voice and is oriented toward the user's mouth. For example, the microphone 223 may be oriented in the longitudinal direction 220 and, in particular, aligned with the longitudinal direction 220 toward the second end 208 and the sound director.

In yet other embodiments, the personal audio device 200 includes a plurality of microphones 223 to capture both environmental sounds as well as the user's voice. For example, the plurality of microphones 223 can include microphones 223 positioned opposite one another and oriented in the longitudinal direction 220 such that the microphones 223 are symmetrical about the vertical direction 220 and/or the body axis 218. One microphone 223, therefore may be oriented toward the first end 206 for the collection of environmental sounds for active noise cancelling or for voice isolation during voice calls on the personal audio device 200. A second microphone 223 may be oriented opposite the first microphone 223 and positioned toward the second end 208 to capture voice commands or the user's voice during a voice call. In an embodiment with a symmetrical ear insert 204, symmetrically positioned microphones 223 (e.g., one microphone oriented toward the user's mouth and one oriented away from the user's mouth) may allow the same operation independently of the direction the personal audio device 200 is placed in the outer ear.

In some embodiments, the orientation of the microphone 223 relative to the ear insert 204 is fixed. In other embodiments, microphone 223 is movable relative to the ear insert 204. For example, the body 202, and hence the microphone 223, may be rotatable about the body axis 218 relative to the ear insert 204 to allow the user to adjust the orientation of a microphone 223 toward the user's mouth. This may be particularly beneficial with a beam forming microphone 223. In at least one embodiment, rotation of the microphone 223 away from the user's mouth, for example, perpendicular to the longitudinal direction 220, may mute the microphone 223.

In some examples, body 202 may be rotatable in discrete positions about the body axis 218 relative to the ear insert 204. For example, the body 202 and ear insert 204 may have complementary keying features that hold the body 202 and ear insert 204 relative to one another at predetermined orientations. The complementary keying features may be complementary magnets, interlocking notches, protrusions, recesses, splines, or other features that allow the rotation and/or selective connection of the body 202 and ear insert 204.

Figure 3:
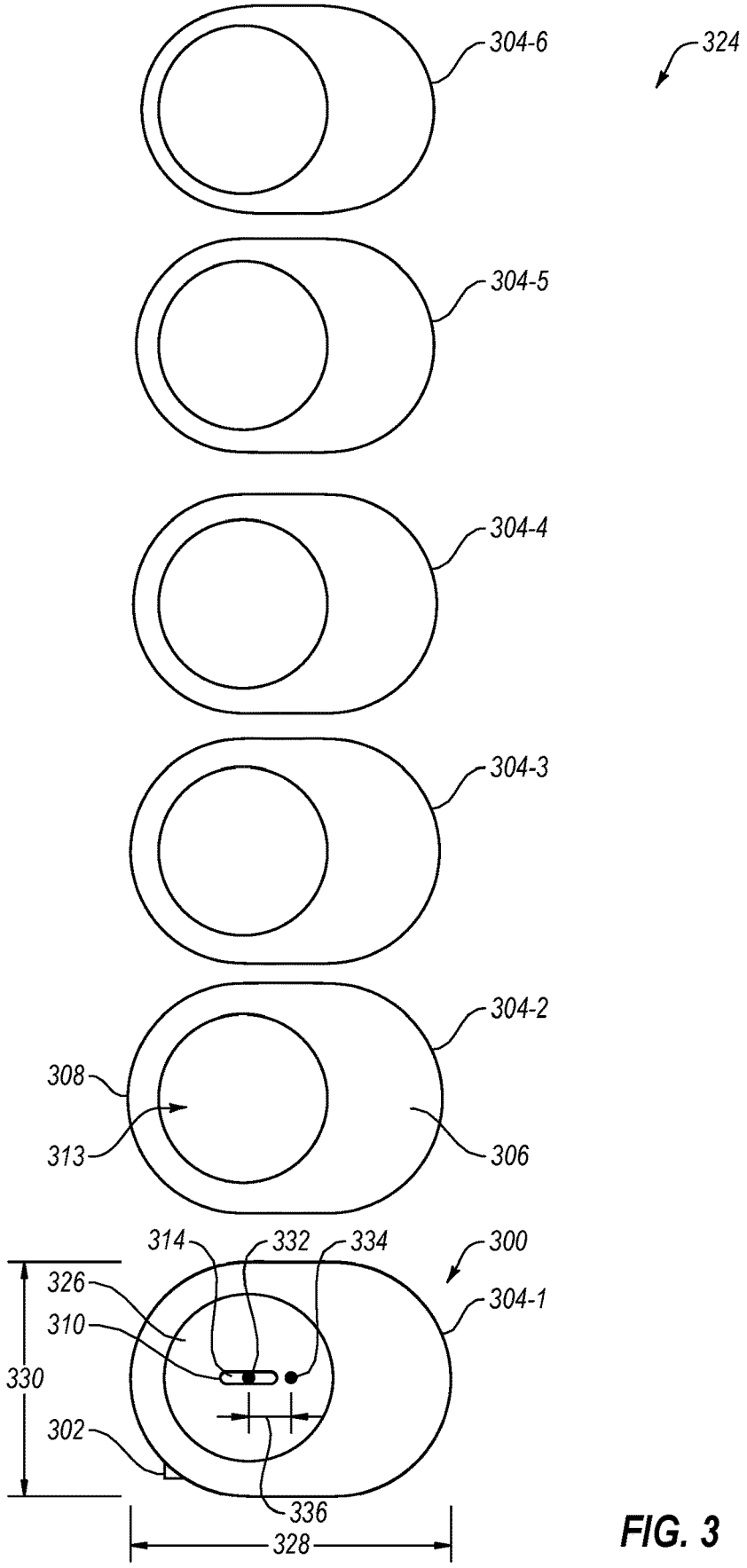
FIG. 3 is a side view of a kit for a personal audio device, according to at least one embodiment of the current disclosure.

FIG. 3 is a side view of another embodiment of a personal audio device 300 with a selectively removable and replaceable ear insert. For example, a kit 324 may include a plurality of ear inserts 304-1, 304-2, 304-3, 304-4, 304-5, 304-6, which a user may interchange to customize the fit of the personal audio device 300. In some embodiments, the ear inserts 304-1, 304-2, 304-3, 304-4, 304-5, 304-6 include an aperture 313 therethrough. The body 302 has a post 326 onto which a first ear insert 304-1 is positioned. The post 326 may be positioned in the aperture 313. The post 326 can include the speaker and/or the opening 310 of the speaker 314. In some embodiments, the post 326 can include a sound director.

The different ear inserts 304-1, 304-2, 304-3, 304-4, 304-5, 304-6 can adjust the fit in the user's outer ear. Each ear insert 304-1, 304-2, 304-3, 304-4, 304-5, 304-6 may have a length 328 in the longitudinal direction and a height 330 in the vertical direction. For example, the different ear inserts 304-1, 304-2, 304-3, 304-4, 304-5, 304-6 may allow customization for users with varying dimensions to the outer ear in different directions. The height of the ends 306, 308 of the ear insert are the area of the end that has the greatest height 330. In other examples, the heights of each end may be determined by where the top and bottom edges (i.e., the edges parallel or approximately parallel to the longitudinal direction) are straight. In some embodiments, an ear insert may have different heights at the first end 306 and the second end 308.

In some embodiments, a length 328 of the ear insert 304 is in a range having an upper value, a lower value, or upper and lower values including any of 16 millimeters (mm), 18 mm, 20 mm, 22 mm, 24 mm, 26 mm, 27 mm, or any values therebetween. For example, the length 328 of the ear insert 304 may be greater than 16 mm. In other examples, the length 328 of the ear insert 304 may be less than 27 mm. In yet other examples, the length 328 of the ear insert 304 may be between 16 mm and 27 mm. In further examples, the length 328 of the ear insert 304 may be between 18 mm and 24 mm. In at least one example, the length 328 may be about 20 mm.

In some embodiments, a height 338 of the ear insert 304 is in a range having an upper value, a lower value, or upper and lower values including any of 2 mm, 4 mm, 6 mm, 8 mm, 10 mm, 14 mm, 18 mm, 22 mm, or any values therebetween. For example, the height 338 of the ear insert 304 may be greater than 2 mm. In other examples, the height 338 of the ear insert 304 may be less than 22 mm. In yet other examples, the height 338 of the ear insert 304 may be between 2 mm and 22 mm. In further examples, the height 338 of the ear insert 304 may be between 6 mm and 16 mm. In at least one example, the height 338 may be about 12 mm.

In some embodiments, the different ear inserts 304-1, 304-2, 304-3, 304-4, 304-5, 304-6 can be used to move the body 302 relative to the user's outer ear by moving a body centerpoint 332 relative to an ear insert centerpoint 334. In some examples, the first end 306 and second end 308 of an ear insert are equal (such as shown in FIG. 2). In other examples, such as the second ear insert 304-2, the first end 306 and second end 308 are dissimilar. The differences in the dimensions of the first end 306 and second end 308 can produce a displacement 336 of the centerpoints 332, 334.

Figure 4:
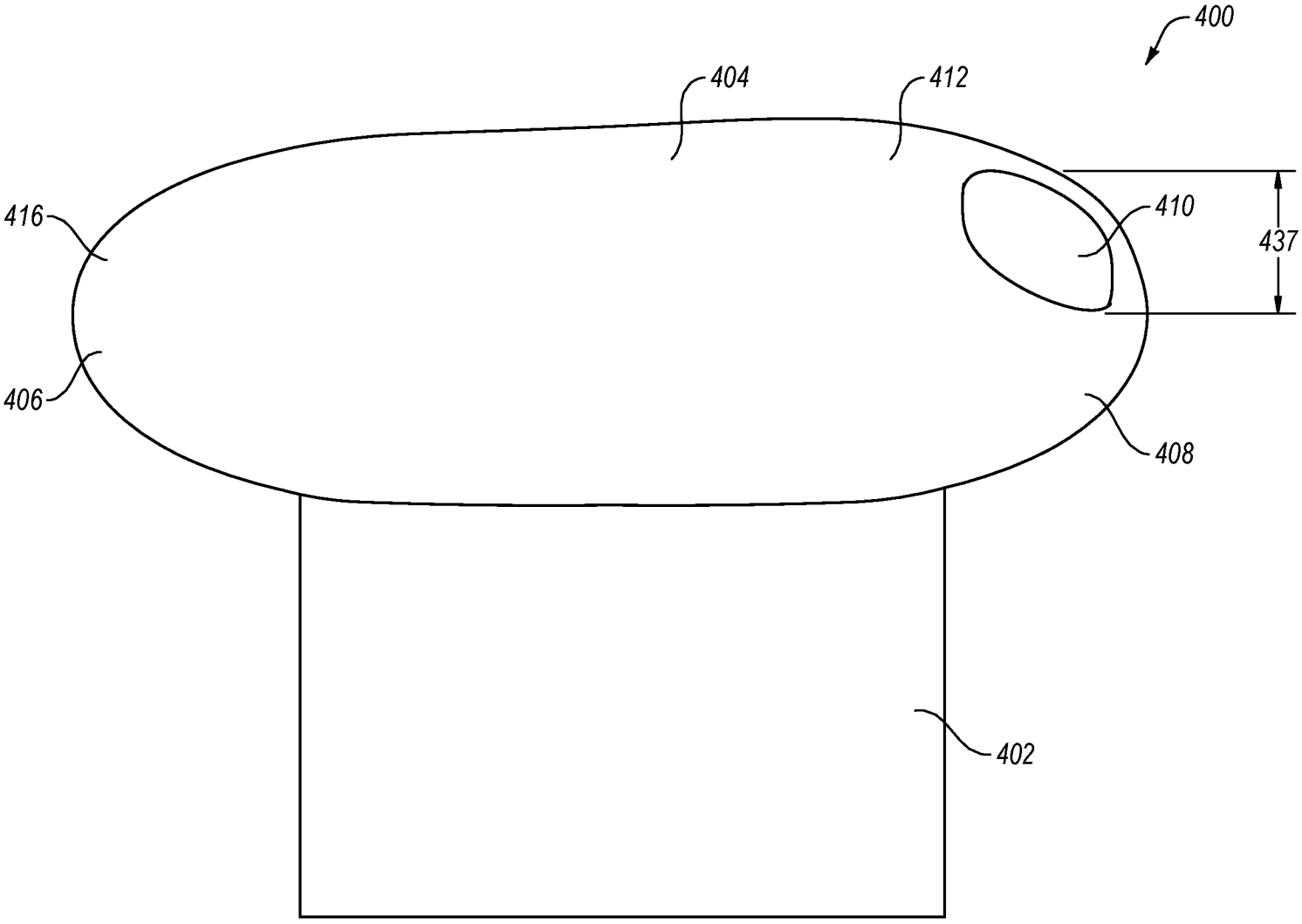
FIG. 4 is a top perspective view of another personal audio device, according to at least one embodiment of the current disclosure.

FIG. 4 is a top perspective view of another embodiment of a personal audio device 400, according to the present disclosure. The ear insert 404 can have a sound director 412 that is in fluid communication with a speaker of the body 402. The sound director 412 is integral with the ear insert 404 and includes a channel or cavity that allows soundwaves to propagate from the speaker through the sound director 412 and out of the opening 410.

In some embodiments, a depth 437 of the ear insert 404 (i.e., in the direction away from the body 402 and in the direction of the body axis) is in a range having an upper value, a lower value, or upper and lower values including any of 2 millimeters (mm), 4 mm, 5 mm, 8 mm, 10 mm, or any values therebetween. For example, the depth 437 of the ear insert 404 may be greater than 2 mm. In other examples, the depth 437 of the ear insert 404 may be less than 10 mm. In yet other examples, the depth 437 of the ear insert 404 may be between 2 mm and 10 mm. In further examples, the depth 437 of the ear insert 404 may be between 4 mm and 8 mm. In at least one example, the length 328 may be about 5 mm.

In some embodiments, the sound director 412 can have a depth 437 that is greater than that of the fin 416 of the ear insert 404. For example, the depth 437 of the first end 406 and the depth of the second end 408 may have a depth ratio of 1:4. In other examples, the depth 437 of the first end 406 and the depth of the second end 408 may have a depth ratio of 1:3. In yet other examples, the depth 437 of the first end 406 and the depth of the second end 408 may have a depth ratio of 1:2. In further examples, the depth 437 may be the same between the first end 406 and second end 408. In at least one example, the depth 437 of the ear insert 404 may be symmetrical in the longitudinal direction.

Figures 1, 5:
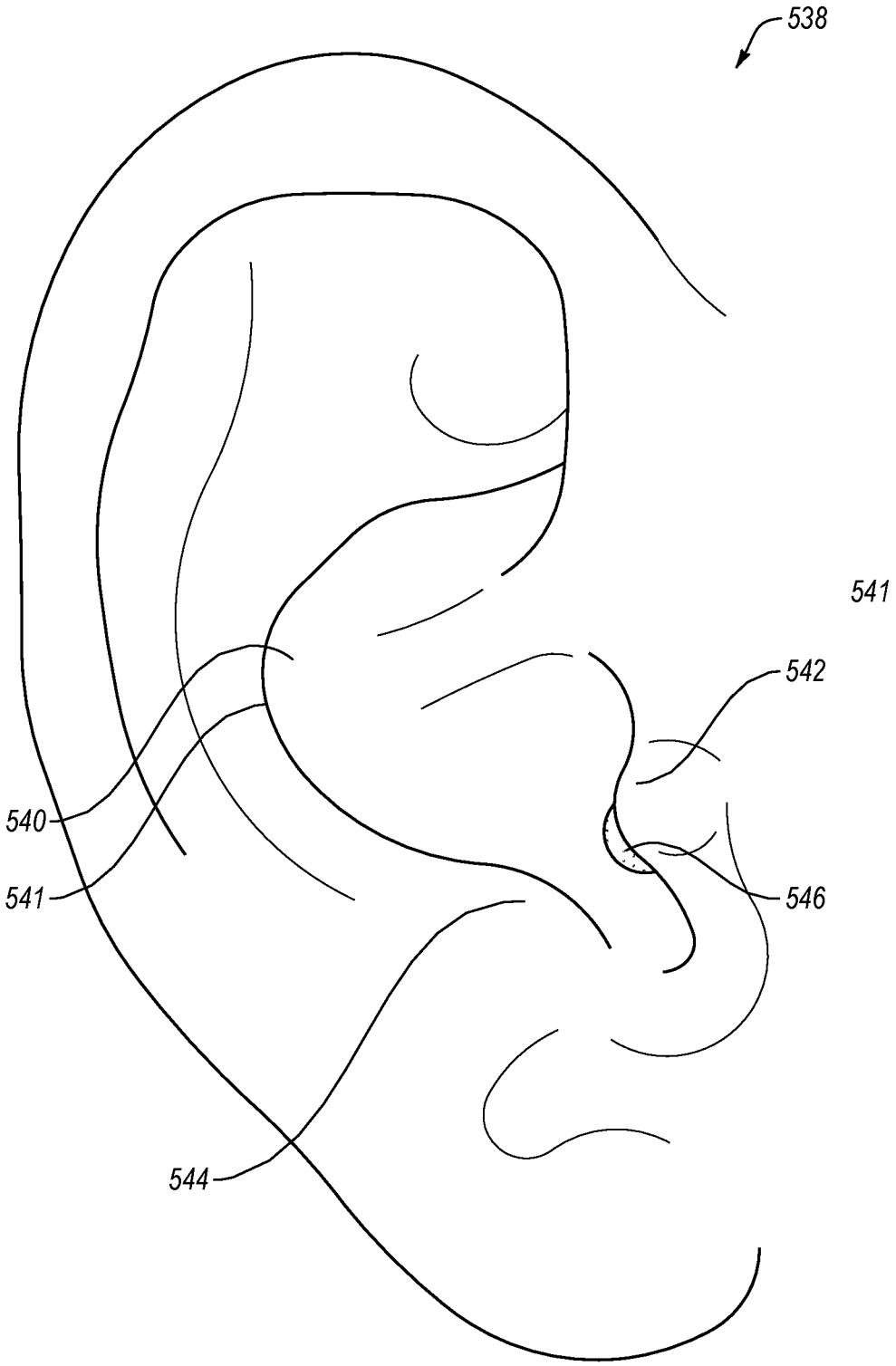
Figures 2, 5:
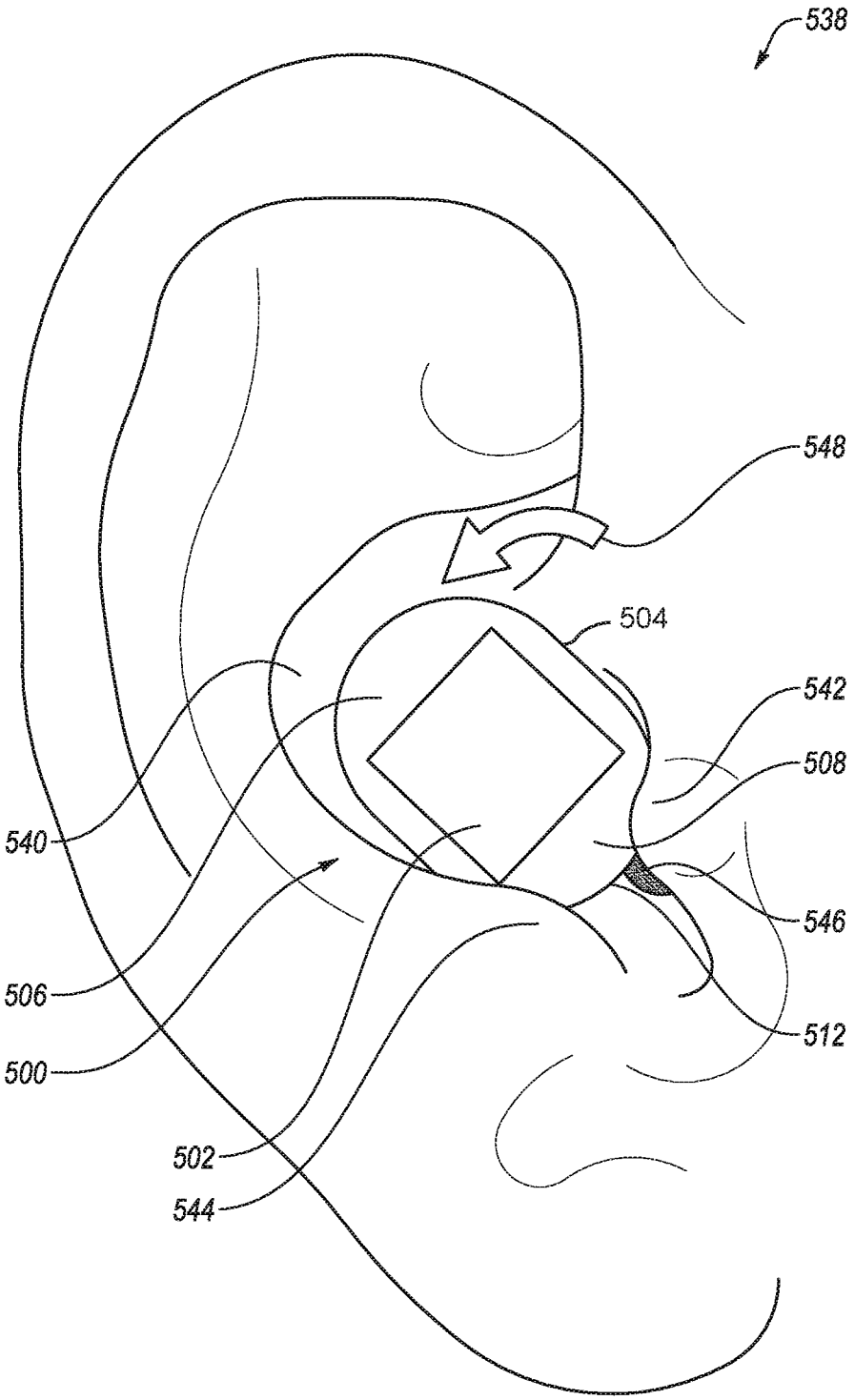
Figures 3, 5:
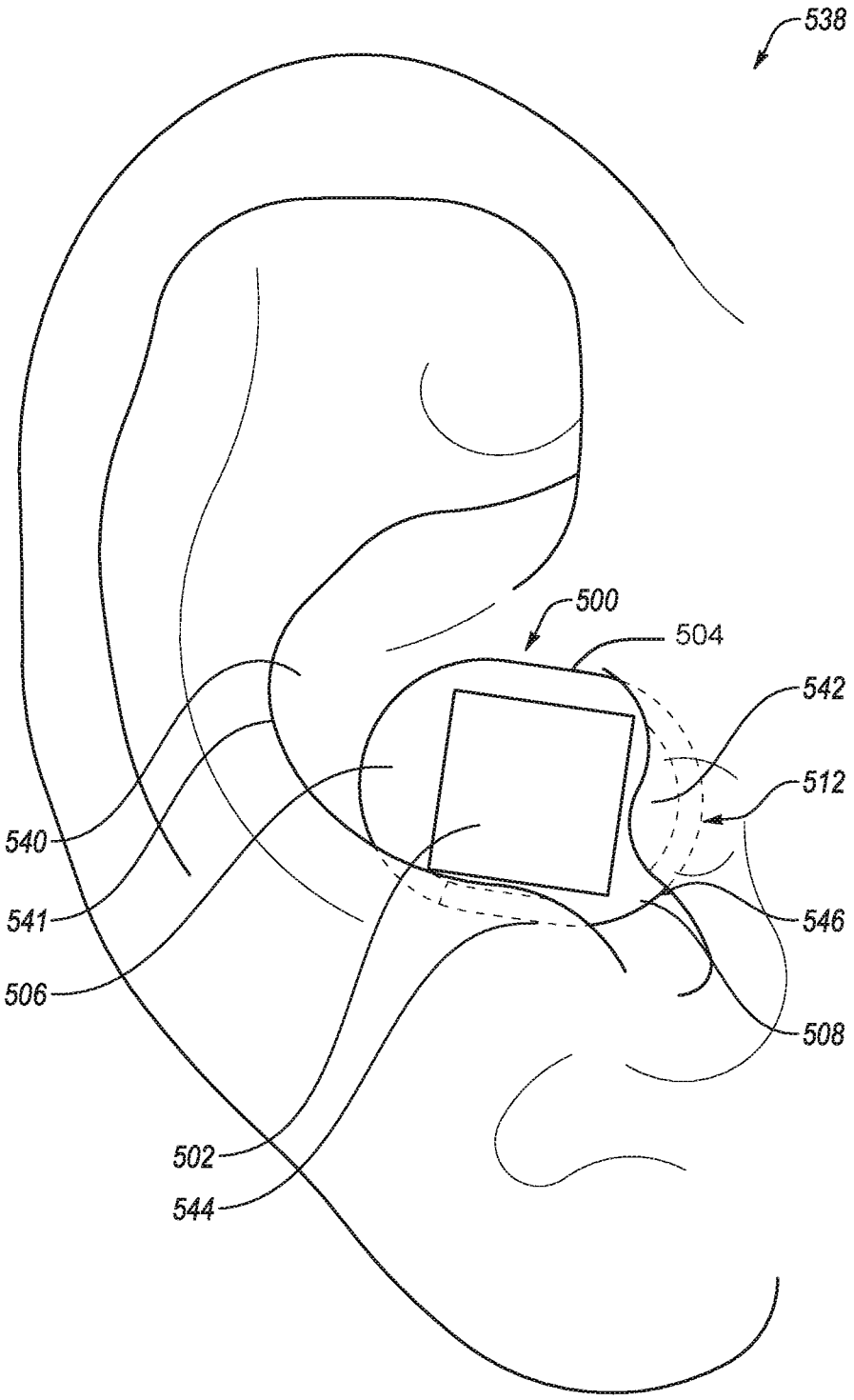

FIG. 5-1 is an illustration of an exemplary user's outer ear 538. The outer ear 538 has a concha 540 and antihelix 541 that is opposed to a tragus 542 and antitragus 544. The tragus 542 partially covers and protects the ear canal 546. The ear canal 546 receives soundwaves and directs the soundwaves to the inner ear, which receives and interprets the soundwaves. Conventional earbuds (such as BEATS POWERBEATS or APPLE AIRPODS) have a conical piece that inserts under the tragus 542 and into the ear canal 546. The conical piece projects soundwaves into the ear canal 546 while sealing the ear canal circumferentially around the conical piece.

While sealing the ear canal can isolate the sounds from the earbud and assist in holding the earbud in place in the user's ear, circumferential sealing around the conical piece occludes the ear canal and prevents the user from hearing environmental sounds. Preventing the user from hearing environmental sounds can be inconvenient for users in a workplace or potentially dangerous for pedestrian users navigating automobile traffic. Additionally, circumferential sealing as a mechanism for holding the earbud in place can limit physical user interactions with the earbud to pressing or clicking on the body of the earbud, as any interaction away from the ear canal or tragus would pull the earbud free from the user's ear.

FIG. 5-2 is an example of inserting an embodiment of a personal audio device 500 according to the present disclosure into a user's outer ear 538. The personal audio device 500 is positioned in the outer ear 538 with the body 502 oriented away from the outer ear 538. The first end 506 is positioned closer to the concha 540 and the antihelix with the second end 508 positioned behind the tragus 542. In some embodiments, the second end 508 may additionally be positioned behind the antitragus 544. The sound director 512 is proximate the ear canal 546, but not positioned in the ear canal 546. The user can rotate the personal audio device 500 in a rearward rotational direction 548 to slide the first end 506 downward and engage the concha 540 with the first end 506.

As shown in FIG. 5-3, when the first end 506 engages the concha 540, the personal audio device 500 becomes compressed between the concha 540 and antihelix 541 and the tragus 542, securing the personal audio device 500 in the user's outer ear 538. In some users, a portion of the personal audio device 500 may be further engaged with the antitragus 544. The outer ear 538 is therefore used to hold the personal audio device 500 in place without engaging the ear canal 546. The sound director 512 is oriented to direct sound into the ear canal 546, but the ear canal 546 is not occluded, and the user can still hear environmental sounds. The user may customize the fit of the personal audio device 500 by varying the amount of rotation of the personal audio device 500 in the outer ear 538 for outer ears 538 with different distances between the antihelix 541 and tragus 542.

In some embodiments, a portion of the sound director 512 may enter the ear canal 546 without occluding the ear canal 546. In other embodiments, no portion of the sound director 512 or ear insert 504 enters the ear canal 546. For example, occluding the ear canal 546 includes preventing the passage of air around an outer surface of the sound director 512.

In a further example, the personal audio device 500 may include active noise cancelling (ANC) that uses a processor in communication with an environmental microphone and the speaker of the personal audio device 500 to cancel out (through deconstructive interference) at least a portion of the environmental sounds. The ear insert 504, according to the present disclosure, does not occlude the ear canal 546 allowing environmental sound to enter the ear canal 546. In situations where a user desires to limit the environmental sounds, such as engine noise on an airplane flight, the ANC may generate a cancelling sound that is the inverse of an environmental sound collected by the environmental microphone. The sound director 512 may direct the cancelling sound toward the ear canal 546 to limit the environmental sound that is perceived by a user, despite the ear insert 504 not occluding the ear canal 546.

FIG. 6 through FIG. 10 illustrate various embodiments of personal audio devices according to the present disclosure. It should be understood that the embodiments shown and described herein are illustrative and any element described in relation to any figure or embodiment may be combinable with any element of any other figure or embodiment. For example, an element described in relation to the embodiment depicted in FIG. 2 may be combinable with any element described in relation to the embodiment depicted in FIG. 8. In another example, an element described in relation to the embodiment depicted in FIG. 3 may be combinable with any element described in relation to the embodiment depicted in FIG. 9. In at least one specific example, the symmetrical ear insert 204 of FIG. 2 may combinable with the post 326 of FIG. 3.

Figure 6:
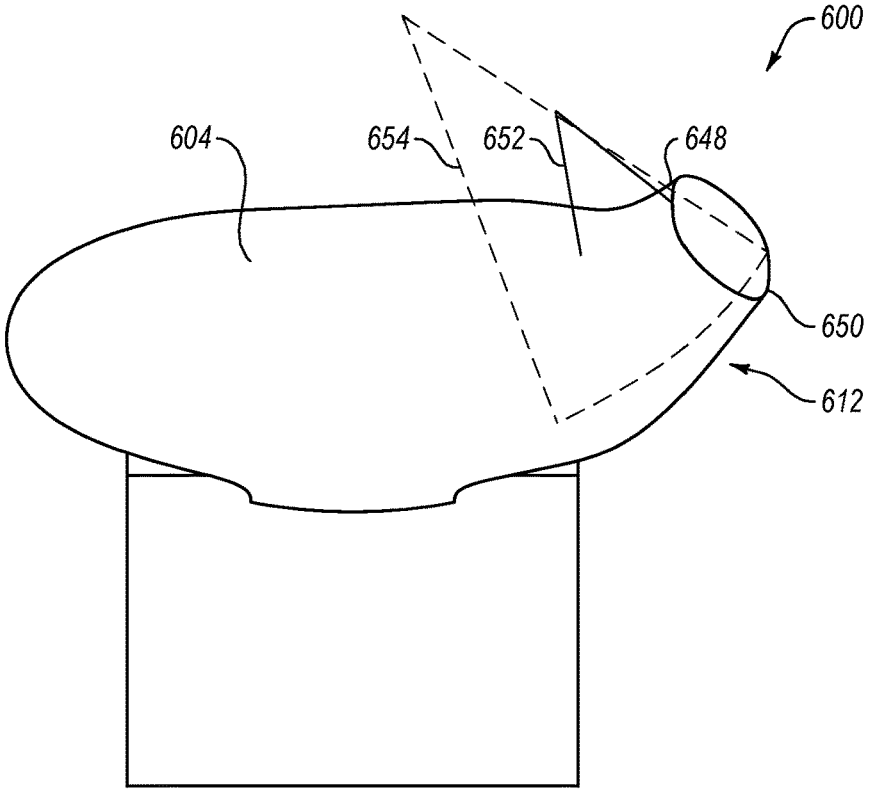
FIG. 6 is a top perspective view of a personal audio device with a curved sound director, according to at least one embodiment of the current disclosure.

FIG. 6 illustrates an embodiment of a personal audio device 600 having a curved sound director 612. The ear insert 604 has a curved sound director 612 that is defined by a first outer surface 648 closer to the user's head and a second outer surface 650 that is closer to the user's tragus when the personal audio device 600 is worn. At least a portion of the first outer surface 648 may have a first radius of curvature 652. At least a portion of the second outer surface 650 can have a second radius of curvature 654. In some embodiments, the first radius of curvature 652 is less than the second radius of curvature 654. In other embodiments, the first radius of curvature 652 is approximately equal to the second radius of curvature 654 (e.g., the first outer surface 648 and second outer surface 650 are parallel).

Figure 7:
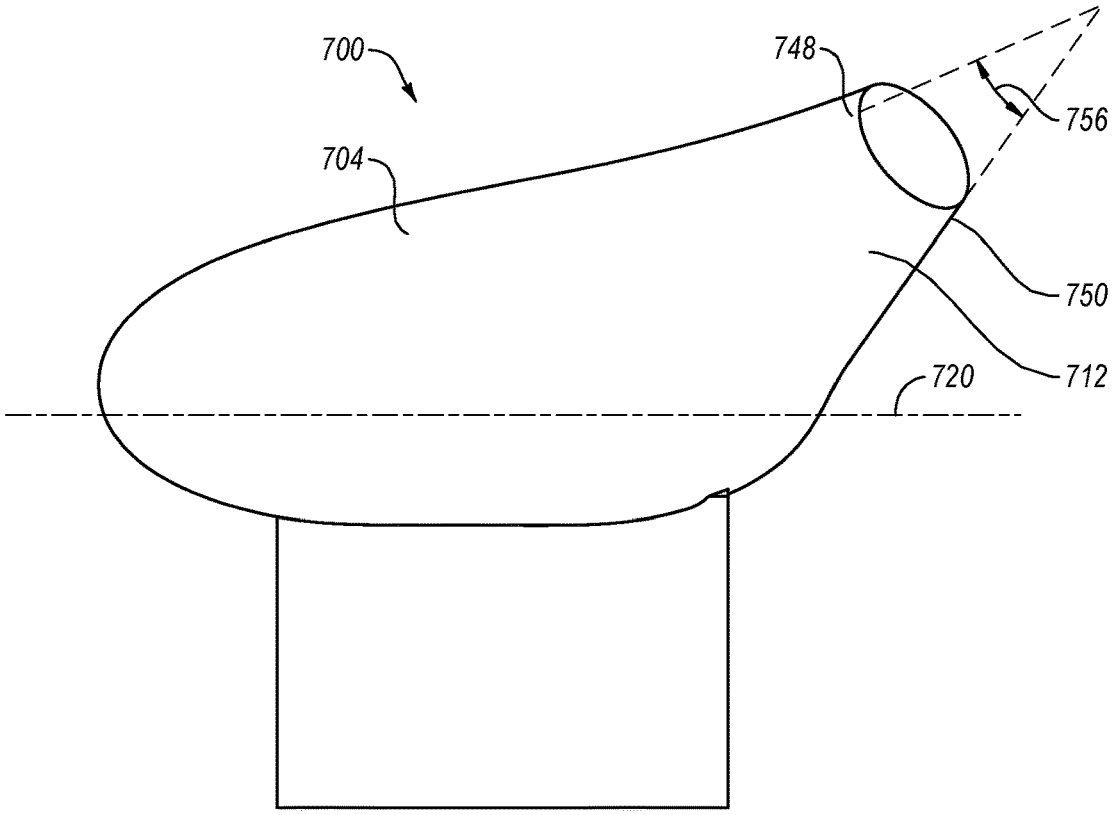
FIG. 7 is a top perspective view of a personal audio device with a tapered sound director, according to at least one embodiment of the current disclosure.

FIG. 7 illustrates an embodiment of a personal audio device 700 having a tapered sound director 712. The ear insert 704 has a tapered sound director 712 that is defined by a first outer surface 748 closer to the user's head and a second outer surface 750 that is closer to the user's tragus when the personal audio device 700 is worn. At least a portion of the first outer surface 748 may be oriented at an angle to the longitudinal direction 720. At least a portion of the second outer surface 750 is oriented at a taper angle 756 relative to the first outer surface 748. In some embodiments, the taper angle 756 is in a range having an upper value, a lower value, or upper and lower values including any of 10°, 20°, 30°, 40°, 50°, 60°, 70°, 80°, 90°, 100°, 110°, 120°, 130°, 140°, or any values there between. For example, the taper angle 756 may be greater than 10°. In other examples, the taper angle 756 may be less than 140°. In yet other examples, the taper angle 756 may be between 10° and 140°. In further examples, the taper angle 756 may be between 20° and 120°. In still further examples, the taper angle 756 may be between 30° and 100°. In at least one example, the taper angle 756 may be about 90°.

Figure 8:
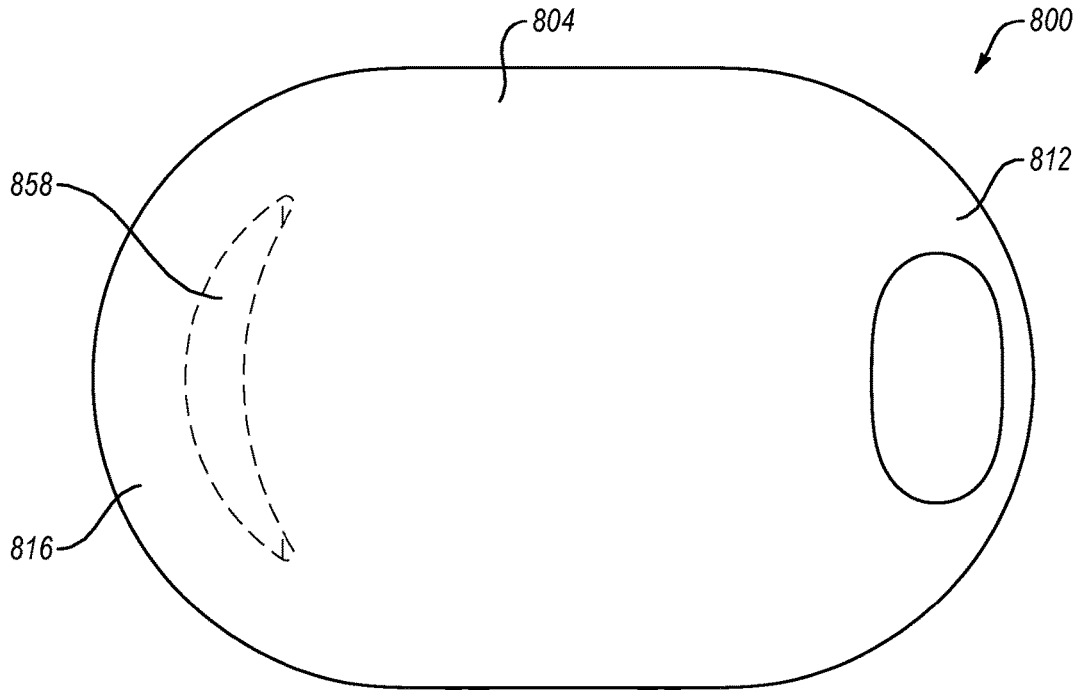
FIG. 8 is a side view of a personal audio device with a relief portion, according to at least one embodiment of the current disclosure.

FIG. 8 is a side view of another embodiment of a personal audio device 800 according to the present disclosure. In some embodiments, the personal audio device 800 has an ear insert 804 that has an integrated fin 816 and a sound director 812. To provide a softer contact surface between the fin 816 and the concha, in other embodiments, the personal audio device 800 has an ear insert 804 with a fin 816 and a sound director 812 that are separate pieces that may have different durometers. In other embodiments, the ear insert 804 may vary in durometer across the ear insert 804.

The ear insert may have a durometer between 20 and 40 where the ear insert 804 contacts the user's outer ear. In some embodiments, the durometer is about 30 throughout the ear insert 804. In other embodiments, the durometer varies between 20 and 40 in the ear insert 804. In yet other embodiments, the fin 816 has a durometer of about 20 and the sound director 812 has a durometer of about 40. In at least one embodiment, the ear insert 804 has a continuous gradient of durometer in a longitudinal direction.

In some embodiments, the ear insert 804 may have a relief portion 858 in or adjacent to the fin 816 to allow the fin 816 to elastically deform under less force, providing a softer contact between the fin 816 and the concha, antihelix, antitragus, and tragus. The relief portion 858 may be a cutout in which material is not present in the ear insert 804. In other examples, the relief portion 858 may be a thinner portion of the ear insert 804 that allows more compression of the fin 816 without changing material composition or creating a hole in the fin 816. In yet other examples, the relief portion 858 may be hollow inside the ear insert 804. In further examples, the relief portion 858 may be a tail similar to the area of the ear insert 804 distal the dashed portion and is open on one side.

Figure 9:
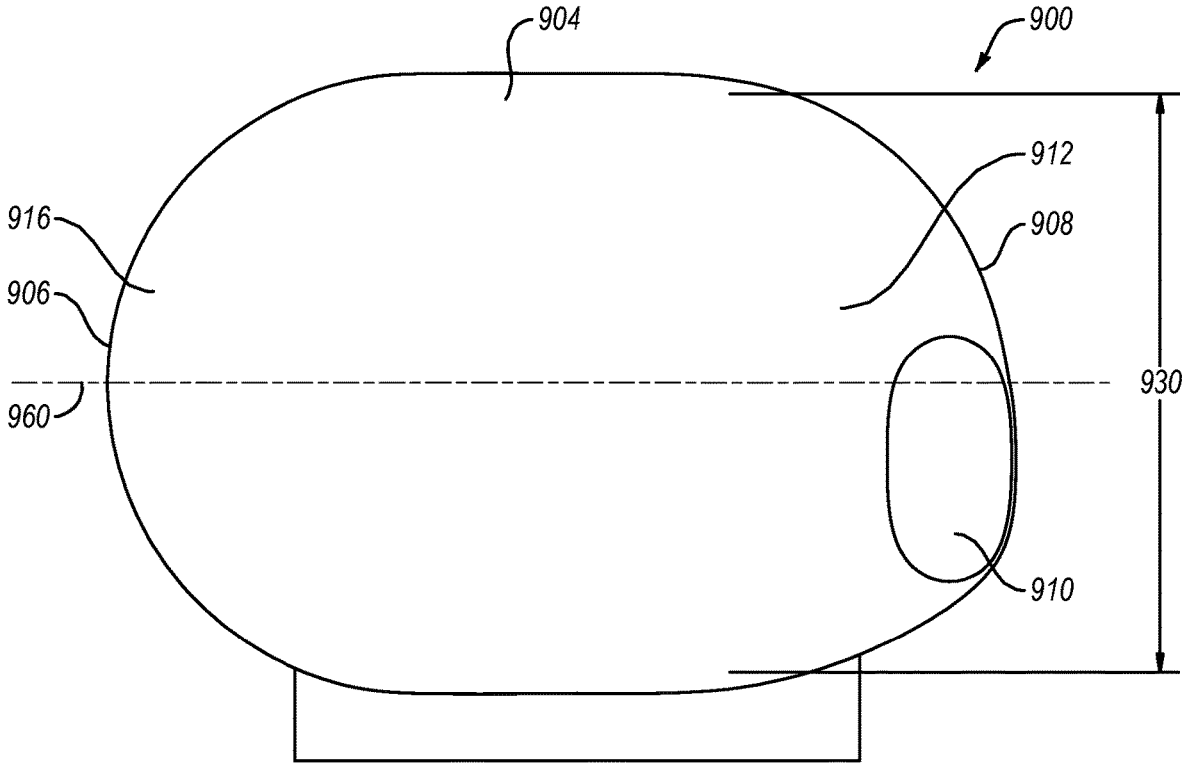
FIG. 9 is a side view of a personal audio device with an offset sound director, according to at least one embodiment of the current disclosure.

FIG. 9 is a side view of another embodiment of a personal audio device 900 according to the present disclosure. The personal audio device 900 has an ear insert 904 with a fin 916 at a first end 906 and a sound director 912 at a second end 908. The sound director 912 and opening 910 of the sound director 912 are displaced from a centerline 960 (in the longitudinal direction) of the ear insert 904. The displacement may be relative to a height 930 of the ear insert 904. In some embodiments, the displacement is a percentage of the height 930 in a range having an upper value, a lower value, or upper and lower values including any of 1%, 5%, 10%, 20%, 30%, 40%, 50%, or any values therebetween. For example, the displacement may be greater than 1% of the height 930. In other examples, the displacement may be less than 50% of the height 930. In some examples, the displacement may between about 5% and 30% of the height 930. In at least one example, the displacement is about 10% of the height 930.

Figure 10:
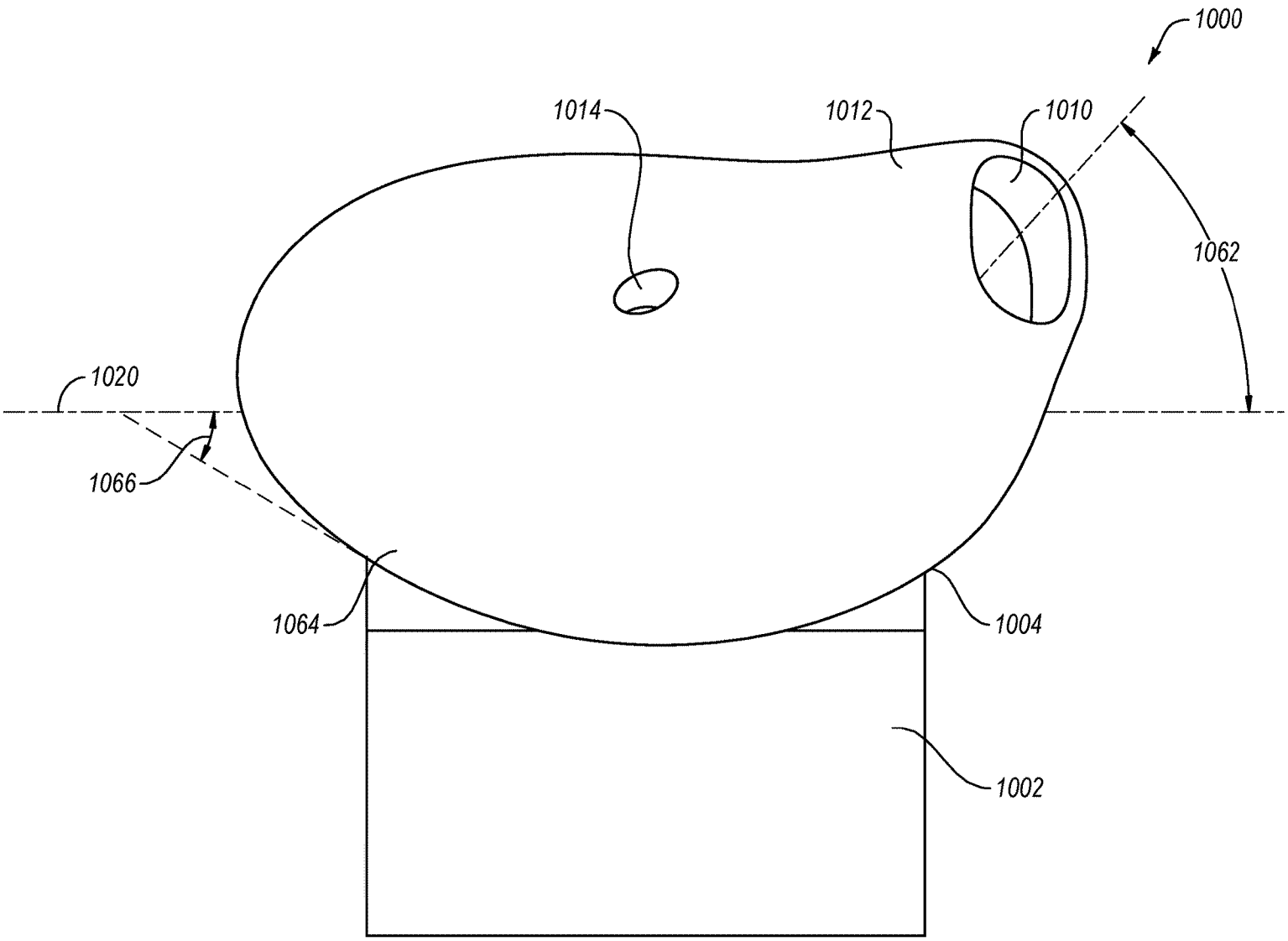
FIG. 10 is a perspective view of another personal audio device, according to at least one embodiment of the current disclosure.

FIG. 10 is a perspective view of yet another embodiment of a personal audio device 1000. The sound director 1012 is a channel within the ear insert 1004 that receives sound from a speaker 1014 in the body 1002 and directs the sound to the opening 110. In some embodiments, the sound director 1012 can redirect the direction of the sound from the speaker at an angle to the orientation of the speaker 1014 or at an angle to an axis of the body. For example, the sound director 1012 may emit the sound from the opening 1010 at a sound director angle 1062 to the longitudinal axis 1020 of the ear insert 1004.

In some embodiments, the sound director angle 1062 is in a range having an upper value, a lower value, or upper and lower values including any of 1°, 5°, 10°, 20°, 30°, 40°, 50°, 60°, or any values therebetween. For example, the sound director angle 1062 may be greater than 1°. In other examples, the sound director angle 1062 may be less than 60°. In yet other examples, the sound director angle 1062 may be between 1° and 60°. In further examples, the sound director angle 1062 may be between 10° and 45°. In at least one example, the sound director angle 1062 is about 30°.

A lower edge 1064 of the ear insert 1004 may be curved to contact and engage with the antitragus of the user's outer ear. At least a portion of the lower edge 1064 is oriented relative to the longitudinal axis 1020 at a lower edge angle 1066. In some embodiments, a lower edge angle 1066 of the ear insert 1004 is in a range having an upper value, a lower value, or upper and lower values including any of 10°, 15°, 20°, 25°, 30°, 35°, or any values therebetween. For example, the lower edge angle 1066 may be less than 35°. In other examples, the lower edge angle 1066 may be greater than 10°. In yet other examples, the sound lower edge angle 1066 may be between 10° and 35°. In further examples, the lower edge angle 1066 may be between 15° and 30°. In at least one example, the lower edge angle 1066 is about 20°.

Various embodiments of personal audio devices are described herein. In at least one embodiment, a personal audio device according to the present disclosure can contact and be secured in a user's outer ear between the concha and the tragus. An ear insert can contact the concha with a first end and the tragus with a second end such that a speaker of the personal audio device can play audio information toward the user's ear canal without entering or occluding the ear canal. In at least one example, a sound director of the ear insert can direct sound from the speaker toward and into the ear canal. The ear insert does not occlude the ear canal, allowing the user to hear environmental sounds for greater awareness and safety compared to conventional in-canal earbuds.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The use of the term "said" in the claims is used to indicate that the claims are not intended to claim any portion of the human body, but rather to help define the meets and bounds of the claim.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. An electronic device for playing audio information to a user's ear having a concha, a tragus, an antitragus, an antihelix, and an ear canal, the device comprising:

a body, the body having a speaker; and an ear insert connected to the body, the ear insert having:

a first end including an integrated fin, wherein the first end projects beyond the body in the longitudinal direction;

a second end oriented in a longitudinal direction to the first end, the second end including a sound director, wherein the second end projects beyond the body in the longitudinal direction, the sound director in audio communication with the speaker to direct sound from the speaker through and out of the sound director; and wherein, while in an inserted position in said user's ear, the ear insert hooks behind the tragus and the antitragus, and wherein the body overlaps the tragus and at least one of the antitragus or the antihelix, wherein the ear insert hooks behind the tragus and the antitragus without the body contacting said user's ear.

2. The device of claim 1, wherein the body includes a post and wherein the speaker is positioned to direct sound out an end of the post, wherein the ear insert is positioned on the post, wherein each of the first end and the second end project beyond a portion of the body proximate the ear insert in the longitudinal direction, and wherein, while in an inserted position in said user's ear, the first end is configured to contact said concha of said user's ear and the second end is configured to contact said tragus of said user's ear, where the second end does not occlude said ear canal of said user's ear.

3. The device of claim 2, while in the inserted position in said user's ear, the second end being further configured to contact said antitragus of said user's ear.

4. The device of claim 2, further comprising a sound director positioned at the second end, the sound director in audio communication with the speaker to direct sound from the speaker through and out of the sound director.

5. The device of claim 2, while in the inserted position in said user's ear, the sound director is not positioned in said ear canal.

6. The device of claim 2, wherein contact by the ear insert with said user's ear retains the electronic device in position relative to said user's ear with sufficient force to allow said user to interact with one or more controls on the body without the electronic device dislodging from said user's ear.

7. The device of claim 1 further comprising a processor in data communication with the speaker and a communication device in data communication with the processor.

8. The device of claim 1, the electronic device being a wireless communication device.

9. The device of claim 1, the ear insert including an insert material with a varying durometer.

10. The device of claim 1, the ear insert having an aperture through which a portion of the body is positioned.

11. The device of claim 1, the ear insert having a first depth at the sound director that is greater than a second depth at the fin.

12. The device of claim 1, the body further including a microphone, the microphone oriented in the same longitudinal direction as the sound director.

13. The device of claim 1, the body being rotatable about a body axis relative to the ear insert.

14. The device of claim 1, the sound director being offset from a centerline of the ear insert in a vertical direction.

15. The device of claim 1, wherein the body overlaps both the tragus and the concha.

16. The device of claim 1, wherein at least a portion of the body is outside of an outer ear of said user.

17. The device of claim 16, wherein an entirety of the body is outside said outer ear of said user.

18. The device of claim 1, further comprising a post, the body being connected to a first end of the post and the ear insert being connected to a second end of the post, the second end being opposite the first end, and wherein the body projects beyond the post in at least the longitudinal direction or a vertical direction, and wherein the ear insert projects beyond the post in at least the longitudinal or the vertical direction.

19. A kit for a personal audio device, the personal audio device having a body, the body having a speaker, the kit comprising:

the device of claim 1, wherein the ear insert is one or more of:

a first ear insert having an integrated fin and sound director oriented in a longitudinal direction opposite one another and the fin and the sound director each projecting beyond the body in the longitudinal direction, the sound director in audio communication with the speaker to direct sound from the speaker through and out of the sound director, wherein the first ear insert has a first length and a first height and the first ear insert is selectively attachable to the body at a post, wherein, in a first installed configuration, with the body connected to the first ear insert, the first ear insert does not occlude an ear canal of a user's ear and a second ear insert having an integrated fin and sound director oriented in a longitudinal direction opposite one another and the fin and sound director each projecting beyond the body in the longitudinal direction, the sound director in audio communication with the speaker to direct sound from the speaker through and out of the sound director, wherein the second ear insert has a second length and a second height and the second ear insert is selectively attachable to the body at the post, the second ear insert differing from the first ear insert in at least one of length or height, wherein, in a second installed configuration with the body connected to the second ear insert, the second ear insert does not occlude said ear canal of said user's ear.

* * * * *